US005820731A

United States Patent [19]

Söderholm

[11] Patent Number: 5,820,731

[45] Date of Patent: Oct. 13, 1998

[54] METHOD AND APPARATUS IN A PAPER OR BOARD MACHINE FOR DEWATERING THE WEB

[75] Inventor: Nils Söderholm, Anjalankoski, Finland

[73] Assignee: Valmet Corporation, Helsinki, Finland

[21] Appl. No.: 557,091

[22] PCT Filed: Jun. 10, 1994

[86] PCT No.: PCT/FI94/00250

§ 371 Date: Mar. 6, 1996

§ 102(e) Date: Mar. 6, 1996

[87] PCT Pub. No.: WO94/29519

PCT Pub. Date: Dec. 22, 1994

[30] Foreign Application Priority Data

Jun. 11, 1993 [FI] Finland ..... 932671

[51] Int. Cl.[6] ..... D21F 1/00

[52] U.S. Cl. ..... 162/203; 162/205; 162/210; 162/301; 162/360.2

[58] Field of Search ..... 162/205, 210, 162/300, 301, 358.1, 358.3, 203, 305, 360.2

[56] References Cited

U.S. PATENT DOCUMENTS

| | | | |
|---|---|---|---|
| 2,821,120 | 1/1958 | Thomas et al. | 162/210 |
| 3,198,694 | 8/1965 | Justus | 162/360.2 |
| 3,285,806 | 11/1966 | Justus | 162/360.3 |
| 3,846,233 | 11/1974 | Kankaanpaa | 62/312 |
| 3,861,996 | 1/1975 | Dorfel | 162/358.1 |
| 4,075,056 | 2/1978 | Ely et al. | 162/305 |
| 5,389,205 | 2/1995 | Pajula et al. | 162/358.3 |
| 5,522,959 | 6/1996 | Ilmarinen | 162/358.3 |

FOREIGN PATENT DOCUMENTS

| | | | |
|---|---|---|---|
| 1 168 492 | 6/1984 | Canada . | |
| 823643 | 1/1984 | Finland | 162/301 |
| 31 07 730 | 9/1982 | Germany . | |

OTHER PUBLICATIONS

Holle "Siebbespannung für die Pressenpartie–VACOFLEX" Zellcheming Apr. 1989.

*Primary Examiner*—Karen M. Hastings
*Attorney, Agent, or Firm*—Pollock, Vande Sande & Priddy

[57] ABSTRACT

An apparatus in a paper or board machine for dewatering a web carried along a first wire section and prior to introduction of the web to a press section of the paper or board machine. The apparatus comprises a first pair of water removing rolls for receiving the web and the first wire section which include a non-suction water receiving roll which is mounted on a first side of the web and has an open surface for receiving and temporarily holding water removed from the web, and a non-suction smooth surfaced roll mounted on the second side of the web. A second permeable wire section is brought in contact with a side of the web opposite that of the first wire section while passing through the pair of rolls. The first and second wire sections produce a press nip when they pass through the pair of water removing rolls with the web to remove water from the web, the water being removed to openings in the open surface of the non-suction water receiving roll. A water receptacle is positioned just downstream of the pair of water removing rolls on the same side of the web as the non-suction water receiving roll for collecting water as water is thrown from the non-suction water receiving roll by centrifugal force produced from rotation. A transfer device for transferring the web traveling on and supported by the first wire section as a closed draw to the press section.

15 Claims, 3 Drawing Sheets

METHOD AND APPARATUS IN A PAPER OR BOARD MACHINE FOR DEWATERING THE WEB

FIELD OF THE INVENTION

The present invention relates to a method for dewatering the web in a paper or board machine. The invention relates also to an apparatus for carrying out the method.

BACKGROUND OF THE INVENTION

Within the end zone of a wire section upstream of a pick-up suction roll, paper and board machines are generally provided with a wire suction roll in an effort to give the web a sufficiently high dry matter content upstream of the press section. This also creates a sufficiently strong web prior to the action occurring in the press section.

One such solution is disclosed in U.S. Pat. No. 4,075,056, wherein the wire suction roll guides the wire and a web lying on top of it within the end zone of the wire section as they are curving upon said suction roll in a certain sector towards a pick-up suction roll. In line with the suction sector provided by the wire suction roll there is a press roll, a so-called lump-breaker roll, placed thereagainst from the side of a web in an effort to seal the web against the wire suction roll, to consolidate the forming web, and to reduce the amount of fiber lumps in the web.

On the other hand, U.S. Pat. No. 3,846,233 discloses a twin-wire papermaking machine wherein, within the end zone of a twin-wire dewatering zone, water is removed by means of a suction roll at which the lower wire deflects towards a pick-up suction roll while water is simultaneously removed through the upper wire as a result of tension of the wires as well as centrifugal force.

In modern paper and board machines, however, the wire suction roll is one of the major consumers of energy as it requires a vacuum system. It is also expensive in terms of its construction. The wire suction roll also creates a noise problem during operation of the machine. In addition, the use of a vacuum reduces the web temperature, which is harmful in the press section. All the above problems associated with suction are further emphasized due to the fact that the increasing machine speeds require an increased vacuum capacity.

SUMMARY OF THE INVENTION

An object of the invention is to eliminate the above drawbacks and to introduce a method for dewatering the web prior to its passage to the press section without a wire suction roil, i.e. without the need for creating a vacuum at this point. Water is removed from the web by means of a open-surfaced roll included in a pair of rolls. The open-surfaced roll and a roll mounted on the opposite side are used to develop pressing on the web so that water is removed from the web into the open places in the roll surface and is discharged from the roll through centrifugal force. Thus, neither of the rolls included in the pair of rolls need be provided with suction and all the problems associated with a suction roll will be eliminated.

Another object of the invention is to introduce an apparatus which does not involve the above drawbacks. In view of fulfilling this object, the pair of rolls provides a press nip, wherein one of the rolls is an open-surfaced roll for effecting the dewatering into the open places in its surface.

BRIEF DESCRIPTION OF THE DRAWINGS

The invention will now be described in more detail with reference made to the accompanying drawings, in which.

DESCRIPTION OF PREFERRED EMBODIMENTS

Figure 1:
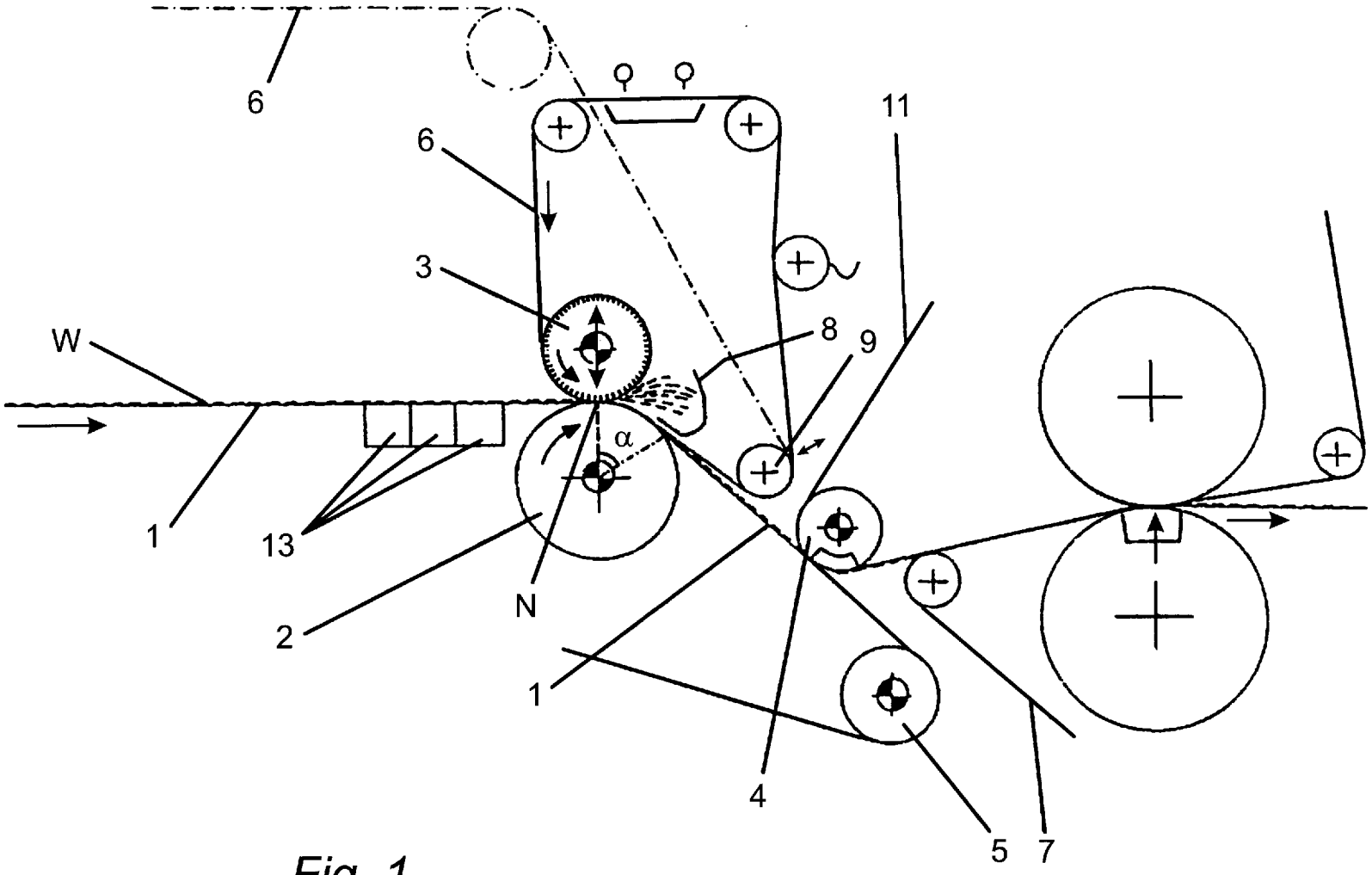
FIG. 1 shows an apparatus of the invention in a side view.

FIG. 1 depicts the end zone of a Fourdrinier wire section in a papermaking machine, that is, a point at which a web W is transferred from a wire 1, upon which it has formed, into a press section. The end section includes a roll 2, guiding the wire 1 of a wire section in such a manner that the wire 1 and the web W lying on top of it are curving or deflecting in a certain sector $\alpha$ towards a drive roll 5, which at the same time serves as a reversing roll for the wire 1. Over the section between the above rolls, the web W is transferred onto an upper press-section felt 7 by means of a pick-up suction roll 4, the felt running therearound and coming into contact with the web W.

Opposite to the wire guiding roll 2 lies an additional roll 3, which is in contact with the web so as to produce a press nip N with the wire guiding roll. The additional roll 3, which thus replaces a previously used lump-breaker roll, is provided with an open surface, whereby the pressing between rolls 2, 3 included in the pair of rolls results in the transfer of water from the web W into the openings included in the surface of additional roll 3. Since the wire and web downstream of the press nip are curving away under the guidance of roll 2, just downstream of the press nip is a good location for a water receptacle 8 into which the water is hurled from the surface recesses of additional roll 3 by virtue of a centrifugal force produced by rotation of the same.

The additional roll 3 can be a standard roll having preferably a hard and open surface (either a blind-drilled or through-drilled roll fitted with a wire sock or a smooth roll possibly fitted with a coarse wire sock). The wire guiding roll 2 is set in a location previously occupied by a wire suction roll and, in turn, must have a type of surface which does not collect water from the web. In practice, the wire guiding roll 2 is a smooth-surface roll, having a surface hardness value of at least 50 PJ, preferably 50–200 PJ. The unit PJ is generally used for indicating the hardnesses of roll coatings in papermaking machines. Thus, there is a suitably long nip N formed between the rolls with the applied loading values which may vary between 10–100 kN/m. The surface hardness and applied loading rate for the roll depend on the dry matter content of the web upstream of the nip N.

The open surface of additional roll 3 is in a dewatering contact with the web W through the intermediary of a suitably finely-meshed, water-permeable fabric.

FIG. 1 illustrates a separate wire loop or run, provided by an additional wire 6 and extending from the side of additional roll 3 through the press nip N. The additional roll 3 is in contact with the web W through the intermediary of additional wire 6, which arrives in the press nip N under the guidance of additional roll 3 and curves thereafter under the guidance of roll 2 in sector $\alpha$ and separates from the top of the web W lying on the wire 1 downstream of said sector. Water presses from the nip N through the additional wire 6 into the additional roll 3. The winding of wire 6 at roll 2 is controlled by means of a wire guide roll 9 included in the wire loop downstream of additional roll 3. The separate wire loop provided by additional wire 6 further includes normal tension rolls and washing sprays. Also water receptacle 8 fits comfortably within the wire loop.

Alternatively, additional wire 6 can be a second wire included in a two-part dewatering zone for removing water from the web therethrough in the opposite direction relative to the dewatering direction of wire 1. This wire is shown in FIG. 1 by a dash-and-dot line and it can extend around a wire guide roll 9 located downstream of nip N.

Figure 2:
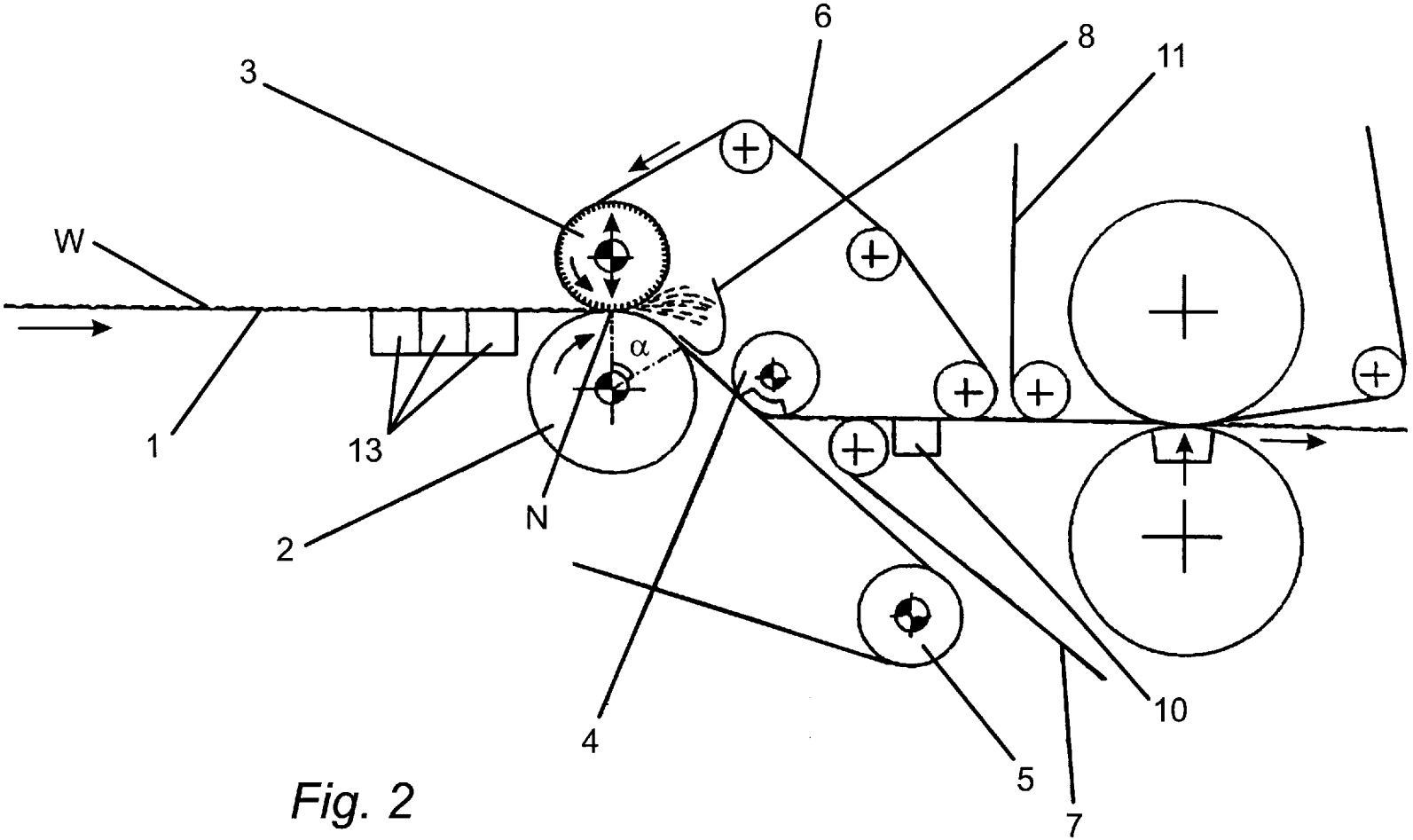
FIG. 2 shows a second embodiment for an apparatus of the invention in a side view.

FIG. 2 depicts a second embodiment, wherein a wire loop created by the above-mentioned additional wire 6 travels on top of a web W all the way to a pick-up suction roll 4, whereby the web W is transferred from wire 1 onto additional wire 6 on pick-up suction roll 4 and from the additional wire 6 by means of a suction box 10 onto a lower press felt 11.

Although additional wire 6 in FIGS. 1 and 2 travels on top of the web W downstream of the press nip N, it can separate from the web immediately after the press nip since the smooth-surfaced roll 2 guiding wire 1 produces a vacuum downstream of the nip for holding the web W on wire 1.

Additional wire 6 is mainly significant in making sure that the web W travels in the right direction downstream of nip N. Additional wire 6 is preferably a wire having a surface identical to that of wire 1.

Another objective with respect to the additional wire 6 is that it should be relatively thin, i.e. it should have a low water holding capacity. The main benefit of the idea is insignificant re-wetting, since a major portion of the water in the pressing action is forced to transfer into the wires and to the open roll. The lower the water holding capacity of the wires, the more water transfers into the open roll and thereby the centrifugal force slings or hurls the water into an external receptacles. The lower water holding capacity of the wires also results in a higher dry matter content for the web downstream of the nip, and a positive effect will be apparent even at lower sheet grammages.

Open-surfaced additional roll 3 can be covered not only by the additional wire 6 but also by a wire sock, which is not necessarily, needed, but its bare jacket surface can only be covered by additional wire 6 at the nip N. It is also possible to employ an open-surfaced roll 3, wherein the bare jacket surface is covered by a coarse wire sleeve topped by a fine wire sock, without a separate additional wire 6. The open pattern of the roll surface can also be produced by means of a coarse wire sock, pulled over a smooth surface and provided with a sufficiently high water holding capacity.

Figure 3:
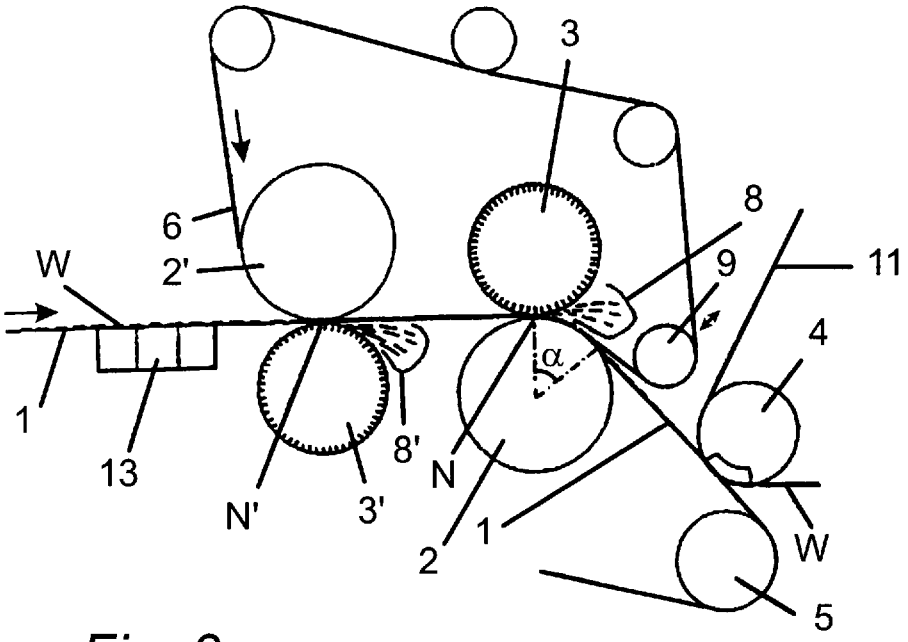
FIG. 3 shows a third embodiment for an apparatus of the invention in a side view.

FIG. 3 depicts an alternative, wherein a nip N created by rolls 2 and 3 is preceded by a second pair of rolls including rolls 2' and 3', which are of the same type as the rolls 2 and 3 included in the downstream pair of rolls but arranged in a reversed order, the open-surfaced dewatering roll 3' against the wire 1 and the opposite roll 2' in contact with the web W through the intermediary of an additional wire 6 extending both through a press nip N' created by the rolls 2' and 3' and through a press nip N of rolls 2 and 3. The water escaping from the web W at press nip N' through wire 1 into the open places of the surface of roll 3' and hurled from the roll by the action of centrifugal force is collected in a water receptacle 8' located below the wire 1. Thus, the successive nips N', N result in the dewatering on both sides of the web W.

Figure 4:
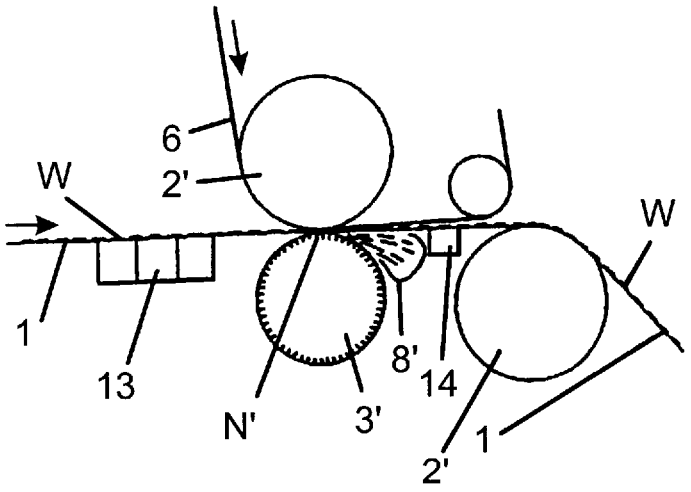
FIG. 4 shows a fourth embodiment for an apparatus of the invention in a side view.

FIG. 4 depicts a pair of rolls provided by rolls 2', 3' which is otherwise similar to that shown in FIG. 3 except that the sector $\alpha$, in which the wire 1 and the web W supported thereby curve towards a pick-up suction roll, and which does not include an additional roll against the roll 2. In this case, the roll 2 may be a regular hard and smooth roll, which has an intact surface or possibly also an open surface. Between the rolls 3' and 2 against the wire 1 lies a transfer suction box 14 for ensuring that the web W holds firmly against the wire while the additional wire 6 separates from top of the web W downstream of the nip N'.

All the above-mentioned rolls 2, 2' having a surface hardness of 50–200 PJ can also be replaced with a prior known shoe press loading roll for creating a smooth long nip with a low pressure, the smooth surface of a roll 2 or 2' having a hardness of 0 PJ.

The first press nip N created by a pair of rolls must be located at the end zone of a wire section downstream of the last dewatering suction boxes at the point where the web has a dry matter content of at least 13 percent. Such boxes are indicated in the figures with reference numeral 13. The applied solution reduces the re-wetting of the web substantially as only some of the water contained in the wires will be returned into the wire. In addition, the significance of re-wetting becomes less and less as the grammage of the web increases.

The invention can be used to produce considerable energy savings and to reduce noise problems experienced with the machines. In addition, the press section downstream of the equipment operates more effectively since the decrease of web temperature caused by the vacuum of a suction roll will be avoided. Furthermore, the invention can be used within a plurality of speed and grammage ranges. As a matter of fact, as the machine speeds are increased, the functioning of the invention will be improved even further by virtue of increased centrifugal force.

Moreover, the invention is applicable to machines having a configuration that is different from that of a Fourdrinier machine shown in FIGS. 1 and 2 wherein the wire 1 is a lower wire and the additional wire 6 is a short overhead wire loop or the upper wire of a twin-wire machine. The invention can be applied from example in twin-wire machines wherein, at the end of a vertical dewatering zone, one of the wires and the web supported thereby are guided by means of a suction roll towards a pick-up suction roll.

I claim:

1. An apparatus in a paper or board machine for dewatering a web carried along a first wire of a wire section of said machine and prior to introduction of said web to a press section of said paper or board machine, said apparatus comprising:

a first pair of water removing rolls for receiving said web and said first wire, including:

a non-suction water receiving roll mounted on a first side of the web and having an open surface for receiving and temporarily holding water removed from the web, and a non-suction smooth surfaced roll mounted on a second side of the web;

a second pair of water removing rolls for receiving said web located along said first wire and web downstream of said first pair of water removing rolls, said second pair of water removing rolls including a non-suction water receiving roll mounted on said second side of the web and having an open surface for receiving and temporarily holding water removed from the web, and a non-suction smooth surfaced roll mounted on said first side of the web;

a second permeable wire brought in contact with a side of the web opposite that of the first wire while passing through said first pair and said second pair of water removing rolls, said first and second wires producing a press nip when passing through said first pair and said second pair of water removing rolls with said web to remove water from said web, said water being removed to openings in the open surface of said non-suction water receiving rolls of said first and second pair of rolls; and a transfer device for transferring the web traveling on and supported by the first wire of the wire section to the press section.

2. An apparatus according to claim 1, wherein the non-suction smooth surfaced rolls have a surface hardness value of at least 50 PJ.

3. An apparatus as set forth in claim 1, wherein the non-suction smooth surfaced rolls are shoe press loading rolls.

4. An apparatus according to claim 1, wherein said second permeable wire comprises a second wire included in a twin-wire dewatering zone of the paper or board machine.

5. An apparatus according to claim 1 wherein said second permeable wire passes through the transfer device.

6. An apparatus according to claim 1 wherein the non-suction smooth surfaced roll of said second pair of water removing rolls guides the first wire section and the web supported thereon towards the transfer device.

7. An apparatus according to claim 1 further comprising a water receptacle positioned just downstream of said second pair of water removing rolls on the same side of the web as the non-suction water receiving roll of said second pair of water removing rolls, for collecting water as water is thrown from said non-suction water receiving roll by centrifugal force produced from rotation.

8. An apparatus according to claim 1 further comprising a water receptacle positioned just downstream of said first pair of water removing rolls on the same side of the web as the non-suction water receiving roll of said first pair of water removing rolls, for collecting water as water is thrown from said non-suction water receiving roll by centrifugal force produced from rotation.

9. An apparatus according to claim 1 wherein said first pair of water removing rolls is placed at a position within the wire section where the web has a dry matter content of at least 13%.

10. An apparatus according to claim 1 wherein said second pair of water removing rolls is placed at a position within the wire section where the web has a dry matter content of at least 13%.

11. A method for dewatering a web prior to introduction of said web to a press section, said web being carried along a first wire section of a wire in a paper or board machine, said method comprising the steps of:

passing said web on said first wire through a first pair of water removing rolls comprising a non-suction water receiving roll mounted on a first side of the web and having an open surface for receiving and temporarily holding water removed from the web, and a non-suction smooth surfaced roll mounted on a second side of the web;

subsequently passing said web on said first wire through a second pair of water removing rolls comprising a non-suction water receiving roll mounted on said second side of the web and having an open surface for receiving and temporarily holding water removed from the web, and a non-suction smooth surfaced roll mounted on said first side of the web;

passing a second permeable wire through said first pair and said second pair of water removing rolls with said web on a side of the web opposite that of the first wire, said first and second wires producing a press nip when passing through said first pair and said second pair of water removing rolls with said web to remove water from said web, said water being removed to openings in the open surface of said non-suction water receiving rolls; and transferring the web traveling on and supported by the first wire of the wire section to the press section.

12. A method according to claim 11 wherein the smooth surfaced rolls have a surface hardness of at least 50 PJ and the rolls included in the first and second pair of rolls are loaded against each other with a force of 10–100 kN/m.

13. A method according to claim 11 comprising the step of removing water within a sector in which the smooth surfaced roll of the first and second pair of rolls guide the wire section and the web supported thereby towards the transfer device.

14. A method according to claim 11 further comprising the step of placing said first pair of water removing rolls at a position within the wire section where the web has a dry matter content of at least 13%.

15. A method according to claim 11, further comprising the step of placing said second pair of water removing rolls at a position within the wire section where the web has a dry matter content of at least 13%.

* * * * *